US007255507B2

(12) United States Patent
Lammers et al.

(10) Patent No.: US 7,255,507 B2
(45) Date of Patent: Aug. 14, 2007

(54) CAPLESS RETRACTABLE SEALED MARKING INSTRUMENT WITH FORWARD CHAMBER

(75) Inventors: Anthony J. Lammers, Gates Mills, OH (US); John R. Nottingham, Bratenahl, OH (US); John W. Spirk, Gates Mills, OH (US); Daniel Jay Wanhainen, Stow, OH (US); Jeffrey Scott Plantz, Cleveland, OH (US)

(73) Assignee: InnoDesk, Inc., Beachwood, OH (US)

( * ) Notice: Subject to any disclaimer, the term of this patent is extended or adjusted under 35 U.S.C. 154(b) by 149 days.

(21) Appl. No.: 10/916,948

(22) Filed: Aug. 12, 2004

(65) Prior Publication Data

US 2005/0047844 A1 Mar. 3, 2005

Related U.S. Application Data

(63) Continuation of application No. PCT/US03/04394, filed on Feb. 13, 2003.

(60) Provisional application No. 60/356,314, filed on Feb. 13, 2002.

(51) Int. Cl.
*B43K 5/16* (2006.01)

(52) U.S. Cl. ..... 401/108; 401/107

(58) Field of Classification Search ..... 401/106–109, 401/101, 111, 99

See application file for complete search history.

(56) References Cited

U.S. PATENT DOCUMENTS 2,874,679 A * 2/1959 Zepelovitch ..... 401/148
3,525,573 A 8/1970 Fend
3,775,015 A * 11/1973 Tsunoda et al. ..... 401/190
4,269,525 A 5/1981 Melikian
4,544,297 A 10/1985 Grossiord
5,022,773 A 6/1991 Waldinger et al.
5,048,990 A 9/1991 Hashimoto et al.
5,092,701 A 3/1992 Lai
5,439,143 A 8/1995 Brown et al.
5,468,082 A 11/1995 Hori
5,823,697 A 10/1998 Talbot
6,033,141 A 3/2000 Blaustein et al.
6,036,385 A 3/2000 Bistrack
6,186,461 B1 2/2001 Pelaez
6,254,297 B1 7/2001 Frazier
6,257,539 B1 7/2001 Pelaez

FOREIGN PATENT DOCUMENTS

CH 612 885 A5 8/1979

* cited by examiner

*Primary Examiner*—David J. Walczak
(74) *Attorney, Agent, or Firm*—Keevican Weiss Bauerle & Hirsch LLC

(57) ABSTRACT

A capless retractable sealed marking instrument has a sealed chamber incorporated in a marker casing. The sealed chamber includes a chamber, a wiper ring, and an annular rim and a seal portion with a cross-slit aperture defining surfaces or flaps which are moved out of contact by a linearly-advanced marker nib to open the seal for extension of the marker nib. The configuration of the disk provides positive sealing force between the lateral sealing surfaces of the seal flaps. Retraction of the marker nib draws the flaps back into the sealed chamber configuration to protect the marker nib and cartridge from atmospheric degradation.

24 Claims, 10 Drawing Sheets

CAPLESS RETRACTABLE SEALED MARKING INSTRUMENT WITH FORWARD CHAMBER

RELATED APPLICATIONS

This application is a continuation of International Application No. PCT/US03/04394, filed Feb. 13, 2003, entitled "Capless Retractable Sealed Marking Instrument with Forward Chamber." That application claimed the benefit of U.S. Provisional Patent Application No. 60/356,314, filed Feb. 13, 2002, under the same title.

FIELD OF THE INVENTION

The present invention pertains generally to marking and writing instruments and, more particularly, to marking and writing instruments having ink-impregnated applicators or cartridges with means to maintain a sealed, airtight chamber in which to house the tip.

BACKGROUND OF THE INVENTION

Capless markers are known in the prior art. Commonly-owned U.S. Pat. No. 6,033,141 is hereby incorporated by reference in its entirety. Generally, these markers provide a retraction and extension carriage to permit the tip of the marker to be concealed within a housing when not in use so as to avoid accidentally contacting clothing or papers when not in use.

Some capless markers include a seal to prevent the drying of the tip due to evaporation of ink into the atmosphere. One such marker is disclosed in the above-referenced patent, U.S. Pat. No. 6,033,141, issued to Blaustein, et al. The marker discloses a single-piece seal mounted adjacent a front cowling. The single-piece seal includes a concave membrane with a slit to permit the extension of the ink cartridge tip for writing and closes upon retraction of the ink cartridge.

A variety of carriage mechanisms may be employed for linear movement of the cartridge within a marker housing. Because the carriage, by necessity, involves moving parts, there is a likelihood that the carriage mechanisms do not provide an airtight closure at the end opposite the writing tip of the marker. Therefore, infiltration of air from the carriage end of the marker can occur despite the placement of a seal adjacent the tip.

There is thus absent from the prior art a retractable capless marker which provides a securely-maintained, airtight chamber of a relatively simple design, which eliminates the need for a separate cap, and which prevents drying of the nib due to air infiltration from either the front or rear end of the marking instrument.

SUMMARY OF THE INVENTION

The capless marker is a highlighter-type of marker that incorporates seal technology to allow the marker to be used without a cap. Preferably, the marking instrument uses a fluorescent-highlighter ink which may be produced in multiple colors, such as yellow and pink, although virtually any type of ink or shape of nib may be used with this device.

What is disclosed is a capless retractable sealed writing instrument including an elongated marker housing with an axial opening. A marker reservoir having a marker nib is disposed within a marker carrier mechanism in the marker housing. The marker carrier mechanism moves the marker reservoir and marker nib linearly within the marker housing to extend and retract the marker nib through the axial opening in the marker housing.

A sealing means includes a sealing chamber, a first seal piece, and a second seal piece. The chamber has a peripheral wall defining a hollow bore. The chamber is disposed coaxially within said reservoir. The reservoir extends at least partially into the hollow bore of the chamber when it is in the retracted position.

The sealing chamber comprises a generally circular peripheral wall defining a hollow bore suitable for passage of a cylindrical reservoir portion. An annular forward terminus at one end of the peripheral wall is adapted to compress an annular rim of the first seal portion. An annular rearward terminus at an opposite end of said peripheral wall has a flat edge adapted for compressing an elastomeric wiper seal encircling the reservoir portion.

The seal portion comprises an annular flange portion in contact with the forward terminus, a circular head portion; and a hollow cylindrical sidewall connecting said forward terminus and said head portion. The head portion includes a flexibly-resilient, re-closable aperture adapted to permit extension and retraction of the marker nib through the head.

One advantage of such a marker is that a detachable cap is not required in order to prevent the marker from drying out. Frequently, detachable caps are set aside and lost or forgotten by the user, and much of the ink remaining in the marker is wasted when the nib dries out and becomes hard.

It is therefore an object of the present invention to provide an airtight seal in which to maintain the marker nib when in the retracted position.

It is a further object of the present invention to eliminate the need for a removable cap to prevent evaporation of the ink and drying of the nib.

It is yet another object of the present invention to maintain, in a fixed position, a sealed chamber for storing the marker nib and to ensure a positive engagement of a secondary seal with the chamber.

DETAILED DESCRIPTION OF THE INVENTION

Using the above-identified Figures, the invention will now be described with respect to various preferred embodiments.

The present invention discloses a means for sealing the nib portion of a marking instrument by trapping the nib within a small, airtight chamber at the forward or writing end of the instrument. A reclosable seal is compressed against the chamber, with a resilient slit or slits that separate when the marker nib is extended through the seal for writing, and reclose to maintain an airtight barrier when the nib is again retracted. An O-ring maintained in compression against the housing forms the nib seal by friction fit against the wall of the ink reservoir. A secondary seal at the rear of the ink reservoir is maintained, so as to prevent exposure of the ink to air that can cause premature drying, from the end opposite the nib.

By this means, a small, airtight pocket is formed around the marker nib when in the retracted position, thereby substantially eliminating evaporation of the ink through the nib. Secondarily, the rear portion of the reservoir is also sealed from the atmosphere to prevent evaporation of ink from the internal fibers in the reservoir. These two sealing means allow the marker to move longitudinally along the axis of the marker by conventional retracting means, and to maintain a seal when retracted, thus only exposing the nib of the marker to air when in use.

The Marking Instrument Housing

Figure 1:
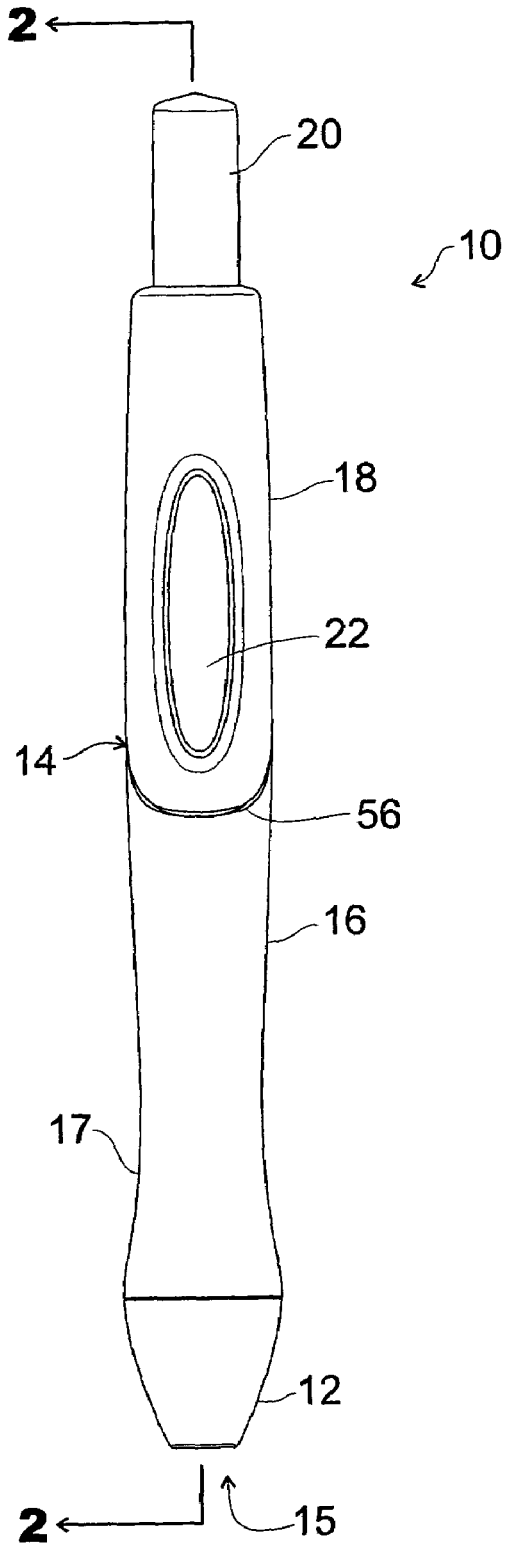
FIG. 1 is an elevational view of a sealed capless marking instrument.

Referring first to FIG. 1, the sealed capless marking instrument is generally designated as 10. A tip portion 12 is attached at the forward end of instrument 10 to a housing portion 14. Housing portion 14 is comprised of a first housing portion 16 and a second housing portion 18. A reservoir plunger 20 protrudes from second housing portion 18 from within housing 14.

Figure 2:
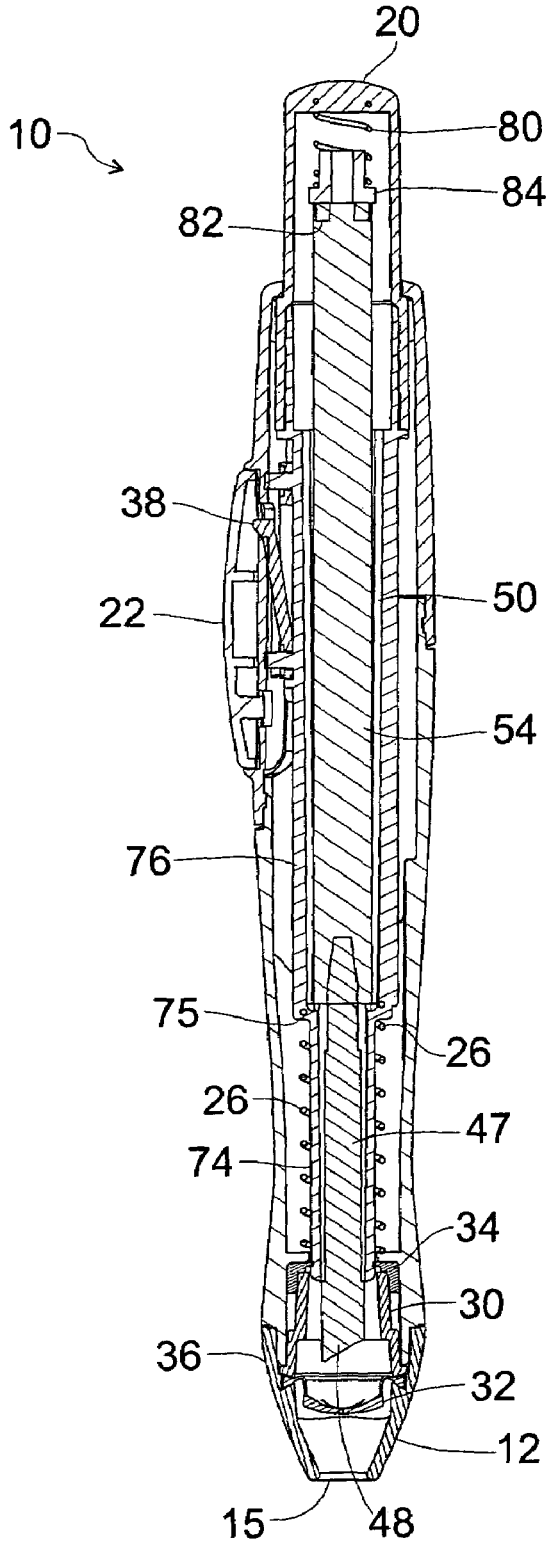
FIG. 2 is a sectional view taken along lines 3-3 of FIG. 1.
Figure 3:
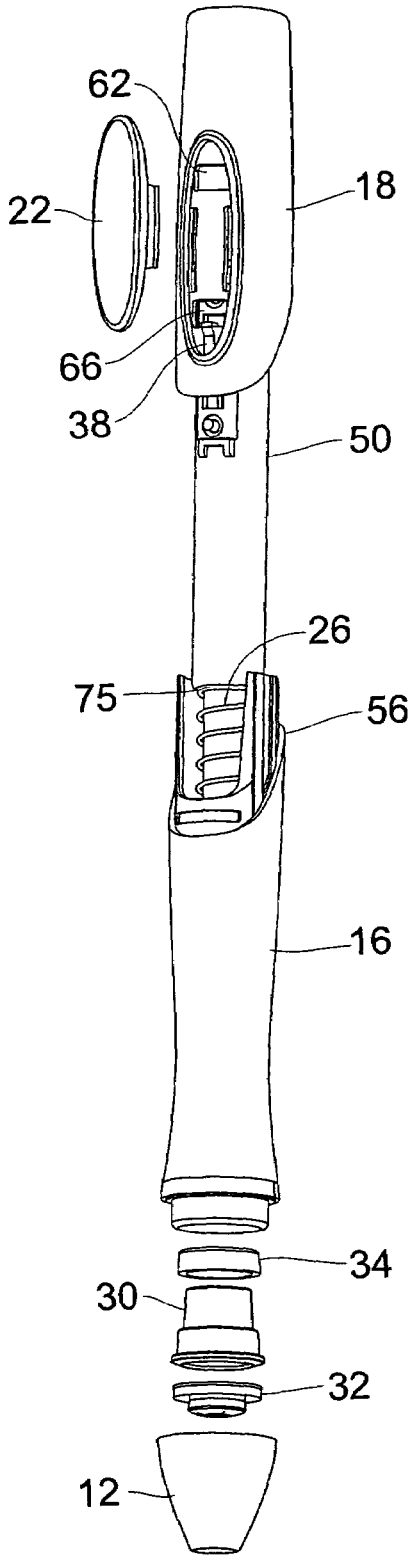
FIG. 3 is an exploded isometric view illustrating the arrangement of internal parts.

Referring next to FIGS. 2 and 3, release button 22 is provided for retracting a reservoir assembly 54 to conceal nib portion 48. Reservoir assembly 54 is contained within housing portions 16, 18, which join to form the single housing portion 14. At the forward end of the marking instrument used for writing, the tip portion is attached via a solvent bond or a snap connection 36 to first housing portion 16. A snap connection 56, 36 is comprised of a plurality of complementary ridges that interlock when forced together. Other connection means, such as threads and bayonet-type fittings, are also effective. Tip portion 12 engages first housing portion 16 via snap connector 36 and maintains the position of chamber portion 30 against a wiper seal 34 made of elastomeric material, such as silicon rubber, at one end and seal portion 32 at the forward end. Wiper seal 34 has a generally L-shaped, cross-sectional configuration conformable to the outer diameter of chamber portion 30. Alternately, the wiper seal 34 may be replaced by an O-ring or a gasket. Chamber portion 30 maintains an airtight cavity in which nib portion 48 is encased when marker 10 is in the retracted position. The limited space contained within chamber portion 30 prevents nib portion 48 from drying when in the retracted position, thereby extending the shelf life of the capless marker 10.

Figure 4:
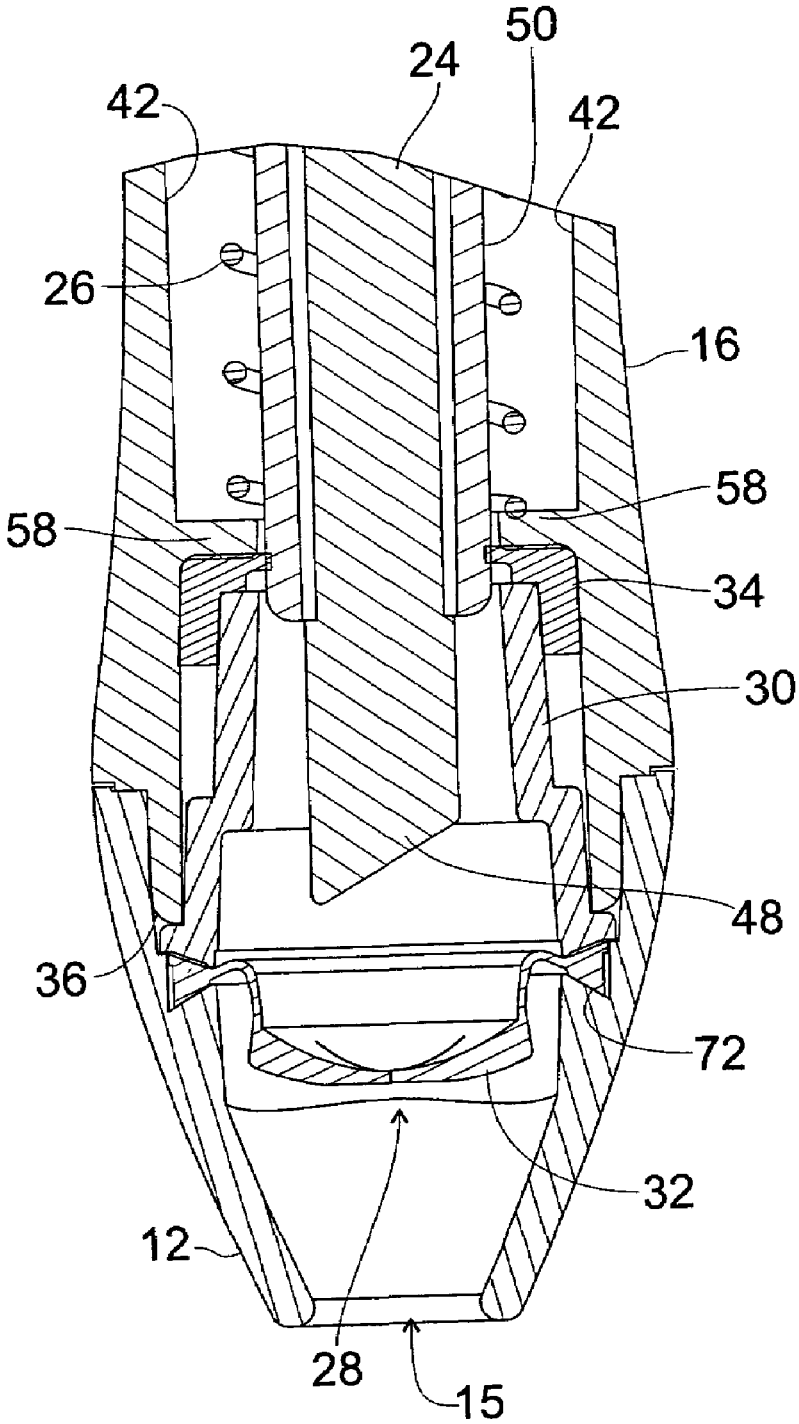
FIG. 4 is an enlarged sectional view of the tip assembly portion.
Figure 5:
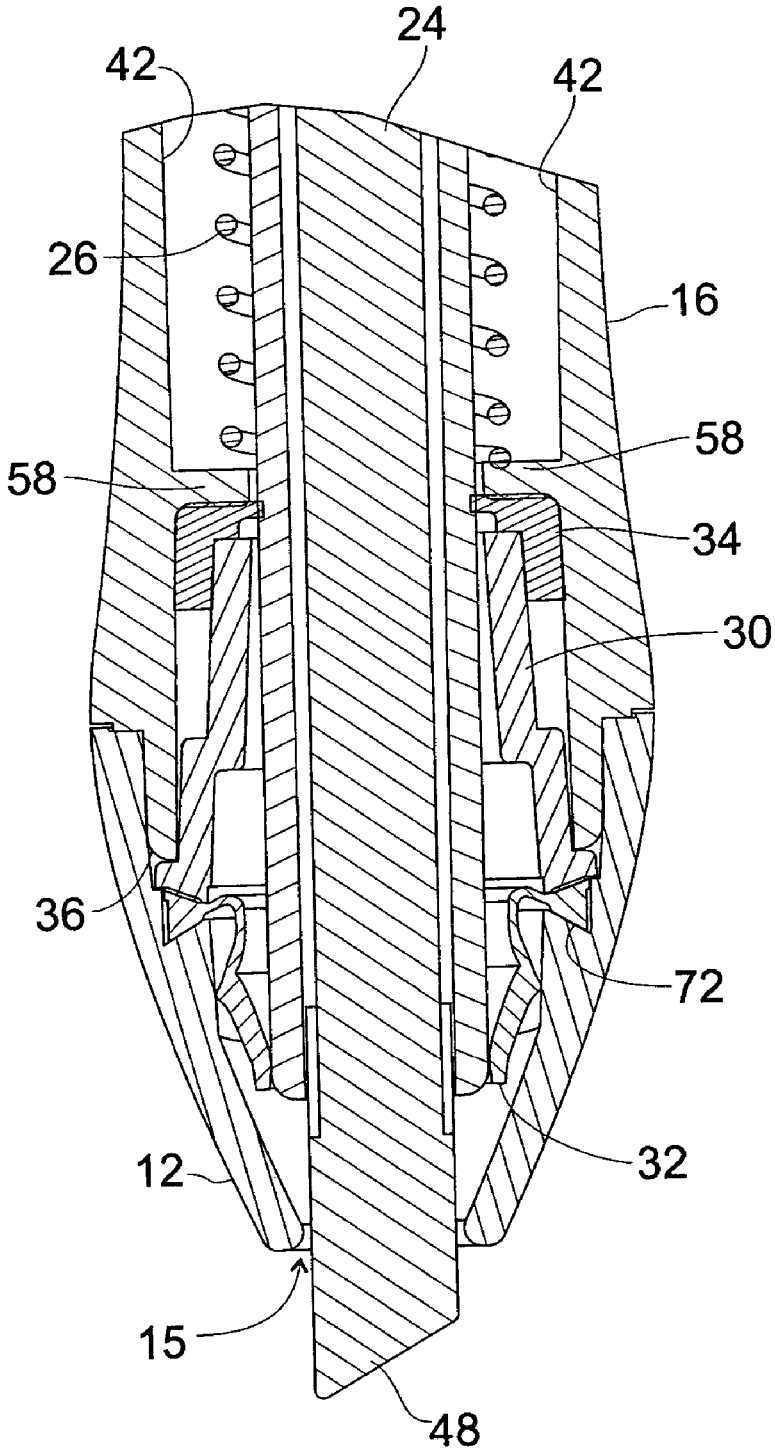
FIG. 5 is a cross-sectional view of the tip portion when the nib is in the extended position.

Referring next to FIGS. 4 and 5, the forward portion of marker 10 is illustrated as an enlarged, cross-sectional view. The tip portion 12 attaches to the first housing portion 16 by means of snap connection 36. The tip portion 12 protects and conceals the concave seal portion 32 which rests adjacent shoulder 72. The chamber portion 30 is maintained within the forward end of the first housing portion 16 by the tip portion 12 when the tip portion 12 is engaged with first housing portion 16. Chamber portion 30 abuts wiper seal 34. Wiper seal 34 rests against an annular rim portion 58 projecting radially-inward from a housing lining wall 42. Rim portion 58 provides a stop limit to prevent axial displacement of the chamber portion 30. Compression spring 26 rests against annular rim portion 58 on the opposite side of wiper seal 34 within the hollow interior of the marker housing portion 14. Compression spring 26 is compressed when the marker 10 is in the extended position and stores energy that is released when release button 22 is depressed, forcing the reservoir assembly 54 to return to the retracted position.

As illustrated in FIGS. 2 and 4, when in the retracted position, the nib portion 48 is situated within the hollow interior of the chamber portion 30, so as to trap the nib portion 48 in an airtight, sealed chamber. The seal is achieved by the closure of slits 28 in seal portion 32. Slits 28 permit the penetration of nib portion 48 when the reservoir assembly 54 is extended to expose the marker for writing. When the seal portion 32 is closed in the retracted position, the forward end of the chamber portion 30 is sealed by way of the rim portion of seal 32. The seal portion 32 is further described in detail below. The opposite end of the chamber portion 30 is sealed by way of a wiper 34 which is compressed against the annular rim portion 58 and which also snugly fits about the external diameter of capillary reservoir housing 50, so as to prevent any air infiltration from the end of the marking instrument opposite the tip portion 12.

A contoured shape is preferred in the marker housing, with an indentation 17 formed in the first housing portion 16 located proximate to the tip portion 12. This assists the user in gripping the instrument for ease of writing. Housing portion 14 has a generally oblong, cross-section in second housing portion 18, transitioning into a circular cross-section in bottom portion 16. The non-circular geometry helps prevent the marking instrument from rolling on a flat surface, such as a desk, when it is laid down. The circular terminus of housing portion 14 facilitates the connection of a substantially conical tip portion 12 to the housing portion 14.

The Seal Chamber

Figure 6:
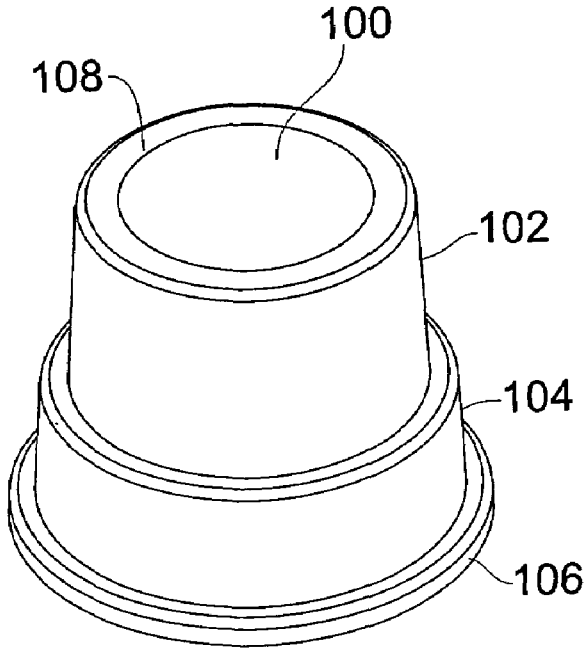
FIG. 6 is an isometric view of the sealed chamber.
Figure 7:
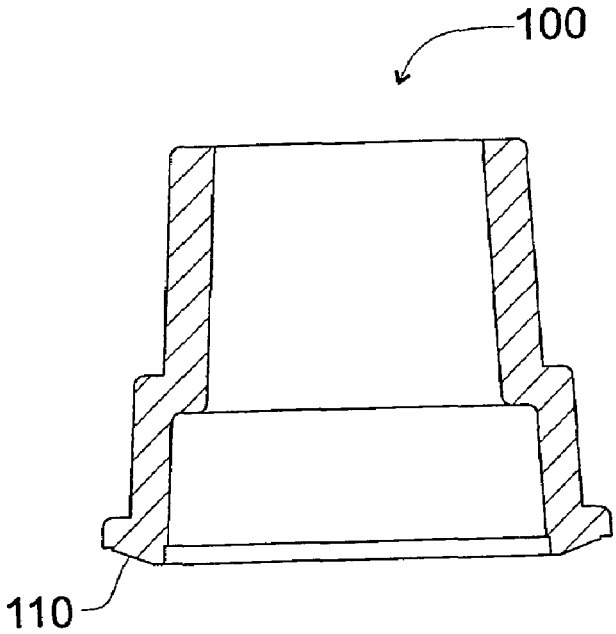
FIG. 7 is an elevational sectional view of the sealed chamber.

Referring next to FIGS. 6 and 7, the chamber portion is generally designated as 30. An aperture 100 extends through a top rim portion 108 through which the reservoir assembly 54 extends. Exterior walls 102, 104 are stepped at such a way as to form a tandem pair of cylindrical walls, first wall 102 being the wall portion nearest aperture 100. First wall 102 is of a smaller diameter than second wall 104. While the walls 102, 104 are generally cylindrical, as it is desirable to include a slight taper from the one end to the opposite end in order to facilitate injection molding processes, which are more easily accomplished when the workpiece includes a slightly tapered exterior wall. Second wall 104 attaches to a flange 106 at the end opposite aperture 100.

The chamber portion 30 is similar in appearance to a thimble open at both ends, and includes a flat top rim portion 108 which engages wiper seal 34 and forces it against annular rim portion 58. Rim portion 58 and wiper seal 34 form an airtight seal around reservoir assembly 54 at one end of chamber portion 30. At the opposite end, flange 106 engages the seal portion 32 and provides an airtight fit.

FIGS. 4 and 7 illustrate a dovetail recess 72 formed at the intersection of flange 106 and tip portion 12, that captures flange portion 104 of seal 32 to prevent the seal from becoming dislocated. An angled surface 110 on the bottom side of flange 104 depresses the pliable material of the annular flange portion 104.

Figure 17:
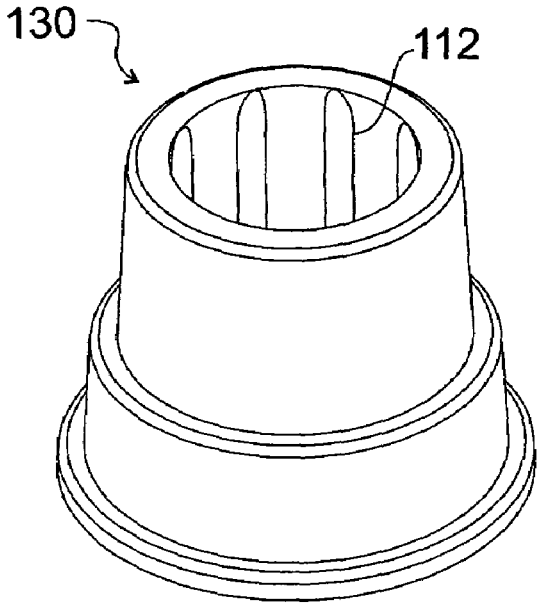
FIG. 17 is an isometric view of an alternate sealed chamber with internal ribs.
Figure 18:
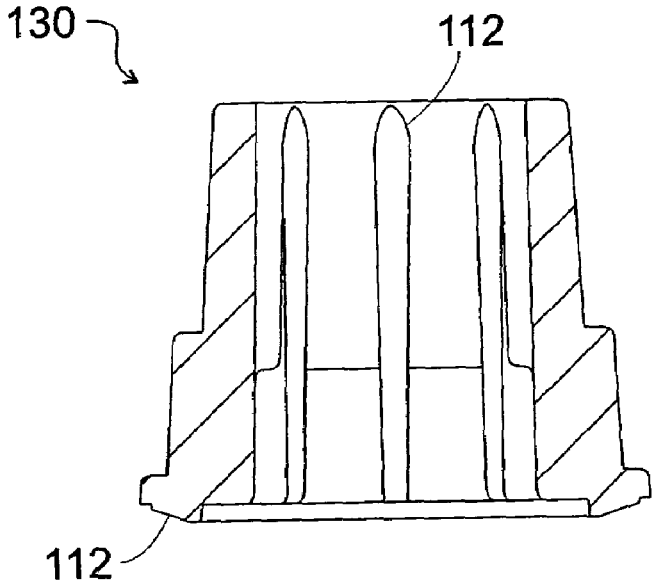
FIG. 18 is a cross-sectional view of an alternate sealed chamber with internal ribs.

FIGS. 17 and 18 illustrate an alternate configuration of a chamber portion 130, having a plurality of interior vertical ribs spaced generally symmetrically about the internal circumference of the chamber walls.

The Seal

Figure 8:
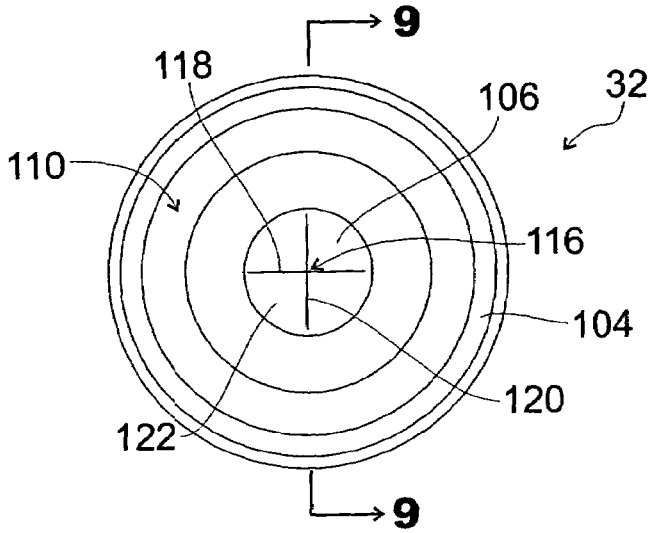
FIG. 8 is a plan view of the seal piece.
Figure 9:
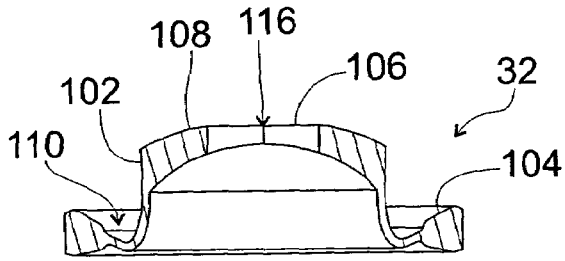
FIG. 9 is a cross-sectional view of the seal taken along the lines 9-9 in FIG. 8.
Figure 10:
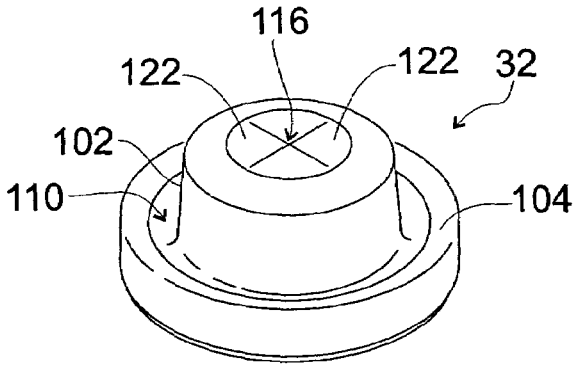
FIG. 10 is an isometric view of the seal piece.
Figure 11:
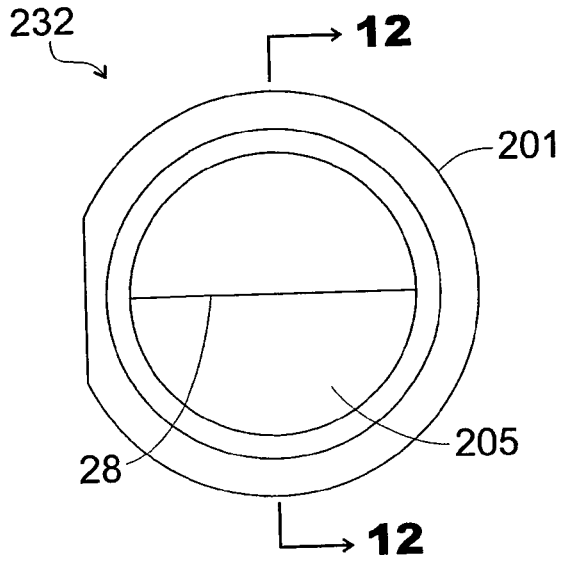
FIG. 11 is a plan view of an alternate concave seal piece.

Referring next to FIGS. 8-10, seal portion 32 is shown in a preferred arrangement. Various configurations may be employed in constructing seal portion 32. One such device is shown and described in U.S. Pat. No. 5,439,143, which is expressly herein incorporated by reference in its entirety. This device, entitled "Dispensing Valve For Packaging," is manufactured by Liquid Molding Systems, Inc., of Midland, Mich. While not used as a valve in the present invention, the present invention employs the resealable properties of such a valve to seal the marker nib 48 within the forward chamber 30. For clarity, the device is referred to as a seal for purposes of this invention. Without setting forth the entire details of the seal construction, the relevant portions will be discussed. The seal 30 contains aperture 116 with a cross-slit construction that includes two intersecting linear slits 118 and 120 that extend through the center portion 106. Slits 118, 120 are formed preferably by slicing through the center portion 106 of seal portion 32.

The illustrated seal portion 100 comprises an integral, single-piece construction, preferably made of a resiliently flexible and pliable material, such as silicon rubber. A thin barrier of propylene glycol or other non-toxic gel may be applied to enhance the sealing properties and to lubricate the aperture 116 and the marker nib 48 to reduce wear on the seal 100 due to repeated operation of the retracting mechanism.

Flange portion 104 is compressed between forward chamber 30 and shoulder 72 of tip portion 12. Flange portion 104 is connected to longitudinal sidewalls 102 via flexible trough 110. Longitudinal sidewalls 102 of seal portion 100 extend outwardly forming a hollow cylindrical guide path for marker nib 48. Sidewalls 102 terminate into head 108. Head 108 has an arcuately-shaped marginal portion tapering from sidewalls 102 to a generally flat center portion 106. An aperture 116 has a pair of perpendicularly-intersecting linear slits 118, 120 that extend completely through center portion 106, and their distal ends are tapered slightly inwardly from the radial edge of center portion 106. Slits 118, 120 define four flaps 122, which flex outwardly and back corresponding to the direction of travel of the nib 48.

Flaps roll outwardly when nib 48 is in the extended position, maintaining a slight pressure around the shaft of the nib 48. When the nib 48 is retracted, flaps 122 gently wipe any excess ink and return to a closed, sealed position.

It is to be understood that aperture 116 may assume many different shapes, sizes and/or configurations in accordance with the marker characteristics desired. For example, aperture 116 may comprise a single slit, particularly when smaller or narrower streams are desired. Aperture 116 may also include three or more slits, for example, as when a geometric cross-sectional reservoir, such as a hexagonal tube, is desired. Other forms of apertures 116, such as holes, duck bills, etc., may be incorporated into seal 32 in lieu of the cross-slits to enhance the sealing properties.

Carriage Mechanism

Reservoir plunger 20 is attached by way of a multi-ringed snap connection and complementary ridges on a reservoir connection 40, which interlock with each other when pressed together. In the disclosed embodiment, reservoir plunger 20 is elliptical in cross-section, and the reservoir connection 40 has a corresponding elliptical cross-section on the side that couples with the reservoir plunger 20.

As shown in FIG. 2, a recoil spring 80 may be optionally deployed within the reservoir plunger 20. The purpose of recoil spring 80 is to cushion the reservoir from the recoil impact when release button 22 is depressed and spring 26 retracts nib 48. Cushioning is desirable in order to prevent or limit deformation of ink fibers (not shown) from occurring within reservoir 50.

A plug 82 fits snugly into the end of capillary reservoir 50 to seal the internal fibers 54 from atmosphere. Shelf 84 on plug 82 provides a circular base for securing one end of recoil spring 80 within reservoir plunger 20. Hub 86 extends from plug 82 to position recoil spring 80.

Referring next to FIGS. 2 and 3, the capillary reservoir housing 50 is slidable along a longitudinal axis to permit the nib portion 48 to extend through concave seal portion 32 and beyond housing portion 14 through an opening 15. The release spring 38 is attached to the capillary reservoir housing 50 via a pair of protrusions 64 on reservoir connection 40. Protrusions 64 engage release spring 38 in a fixed position relative to the release button 22 and a slot 62 when in the retracted position. By pressing the reservoir plunger 20, the capillary reservoir housing 50 advances along the longitudinal axis until the release spring 38 engages the release button 22. When external pressure is applied to the release button 22, for example, by a person's thumb, reservoir assembly 54 returns to the retracted position by releasing the energy stored in compression spring 26. Release spring 38 is forced back until it engages the first slot 62.

It is to be understood that the disclosed carriage mechanism employed in the present invention represents but one of many such mechanisms known in the art. For example, a rotary cam-follower or a ratchet mechanism may be substituted for the release spring/pushbutton arrangement disclosed herein.

Reservoir Assembly

Referring next to FIGS. 2 and 3, the reservoir assembly is illustrated. FIG. 2 shows the nib portion 48 which is adjacent one end of capillary reservoir assembly 54. Nib portion 48 is maintained adjacent capillary reservoir assembly 54 partially by a friction fit between the inner walls of capillary reservoir assembly 54 and a cylindrical shaft 47 of nib portion 48. Nib portion 48 extends backward into capillary reservoir assembly 54 in which the ink is impregnated. Capillary reservoir assembly 54 is contained within capillary reservoir housing 50. Capillary reservoir housing 50 is comprised of a pair of tubular sections 74, 76. First tubular portion 74 is of a smaller diameter which contains the forward nib portion 48 extending out of the end of the first tubular portion. The first tubular portion 74 is joined with the second tubular portion 76 of a larger diameter, which extends rearward into the hollow interior cavity of reservoir plunger 20. A shelf 75 is defined at the connection between tubular sections 74, 76. Shelf 75 provides a circular base for securing one end of compression spring 26. The second tubular portion 76 may contain a larger diameter filament or capillary reservoir assembly 54. The nib portion 48 and capillary reservoir assembly 54 are constructed of a polyester fiber in the disclosed embodiment and impregnated with a writing fluid, such as fluorescent ink or the like.

A wide variety of inks may be employed in the reservoir assembly 54; however, the characteristics of the ink used in the disclosed embodiment include odorless, quick-drying, water-resistant, fade-resistant, and non-toxic fluid consistent with ASTM 4236 Standard. The nib portion 48 may be chisel-shaped for highlighting purposes or more pointed for writing purposes.

The seal 32 may incorporate a thin plastic membrane covering the seal portion 32, which is punctured at the first use so as to provide additional protection and preserve the ink stored therein during the shelf life period prior to the first use.

Alternate Seal Configurations

Figure 12:
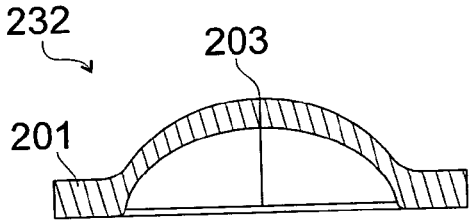
FIG. 12 is a cross-sectional view of the alternate concave seal taken along the lines 12-12 in FIG. 11.
Figure 13:
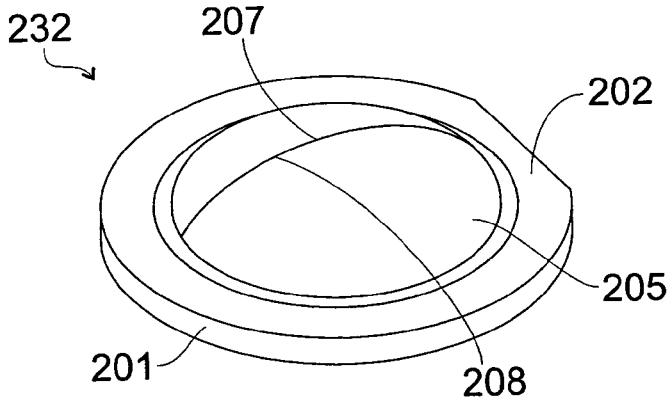
FIG. 13 is an isometric view of the seal piece.
Figure 14:
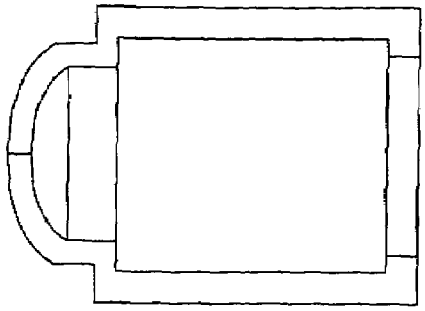
FIG. 14 is a sectional schematic view of an alternate chamber configuration.

Concave seal 232, shown in FIGS. 12-14, is held within the marker tip portion 12. The seal 232 includes a generally annular rim 201 with an internal diameter (ID) at least equal to or greater than a diameter of an opening 15.

Annular rim 201 includes a flat edge 210. Flat edge 210 provides alignment means to orient the direction of the slit 28 to coincide with the edge of a nib chisel point 49. Flat edge 210 prevents the rotational movement of the seal 232, relative to chamber portion 30 and tip portion 12, after the tip portion 12 is snapped together with the housing 14. When using a flat edge 210 type rim 201, the chamber portion 30 may have a flat, rather than tapered, flange bottom 110. A semi-circular or pointed bead (not shown) optionally depends from the flange bottom 110 that will impinge upon the rim 201 for better engagement with the chamber portion 30.

The seal 232 further includes a flexible concave disk 202 attached to and within the circular interior area defined by the annular rim 201. As best shown in FIG. 13, the concave disk 202 has a cross-section in the form of an arc A, with an apex 203 of arc A oriented to face the marker nib 48 when the marker nib 48 is in a fully-retracted position within the marker housing 14. The concave disk 202 further has a full-diameter, full-width slit 204 through the radial center of the disk, which forms two cooperative sealing disk halves 205, 206 which are deformable to allow passage of the marker nib through the slit upon linear advancement of the marker cartridge and marker nib by the marker carrier mechanism to an extended position.

The concavity of the disk halves 205, 206 biases mating edges 207, 208 tightly together to form a highly-effective atmospheric seal to the interior of the marker housing, thereby retaining the ink moisture in the marker nib and the marker cartridge. The concavity of the disk halves with an apex 203 oriented into the interior of the marker casing and toward the marker tip is especially effective in forming a seal sufficient to retain moisture within the marker cartridge and nib. As shown in FIG. 5, the marker nib is linearly projected through the seal 232 and opening 15, thereby deflecting the disk halves 205, 206 to spread about the slit. In this position, the disk halves are tightly wrapped about the circumference of the marker cartridge, thereby effectively sealing the section of the marker reservoir, which remains in the housing 14 from the atmosphere, while the marker nib is exposed. Upon retraction, the disk halves 205, 206 effectively wipe the marker nib clean as they are brought back to the sealed concave position by the linear motion of the cartridge. The concave configuration of the disk halves 205, 206 is especially effective in establishing a tight seal since the amount of force required of the tip to urge the halves apart is greater than required for a convex, outwardly-oriented seal. Also, upon retraction, the marker nib mechanically drags the disk halves back to the concave position, forcing the mating surfaces together to reestablish the seal 32.

The seal 32 is preferably formed or molded in the described configuration from a suitable silicon material such as GE.RTM. Silicon SE 6260, a high-performance, moldable, and pigmentable silicon compound.

Figure 15:
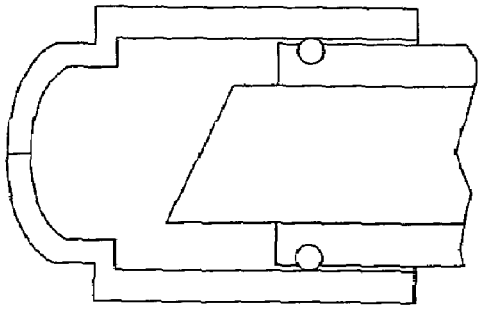
FIG. 15 is a sectional schematic view of an alternate chamber configuration.
Figure 16:
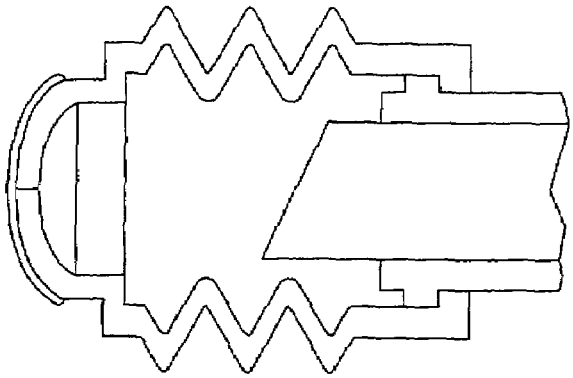
FIG. 16 is sectional schematic view of an alternate chamber configuration.

Referring to FIGS. 14-16, it is also within the scope of the present invention and the appended claims to include the flexible seal portion attached to the forward chamber, either by adhesively affixing the seal portion on the rim or by integrally molding the seal onto the forward chamber (FIG. 14). Additional configurations are shown on FIGS. 14-16 and include a traveling sealed chamber (FIG. 15) and a bellows-type extendable seal (FIG. 16) attached at one end to the reservoir cartridge.

A vent tube (not shown) may be placed longitudinally within capillary reservoir assembly 54 to equalize pressure within the reservoir to prevent vapor-lock and facilitate the flow of ink to the nib 48.

Although the present invention has been described above by reference to an embodiment of the invention, the present invention is not limited to the embodiment described above. Modifications and variations of the embodiment described above will occur to those skilled in the art, in light of the above teachings without departing from the spirit of the present invention. It is the present invention, therefore, to be limited only as indicated by the scope of the claims appended hereto.

We claim:

1. A capless retractable sealed writing instrument comprising:

an elongated marker housing with an axial opening;

a marker reservoir having a marker nib and held within a marker carrier mechanism within the marker housing, the marker carrier mechanism operative to linearly move the marker reservoir and marker nib within the marker housing, to extend and retract the marker nib through the axial opening in the marker housing;

a sealing means having a sealing chamber, a wiper seal piece and a forward seal piece; and said chamber having a peripheral wall defining a hollow bore, the chamber disposed coaxially with said reservoir, whereby the reservoir extends at least partially into said hollow bore with the wiper seal piece sealing against the reservoir, and wherein the forward seal piece extends from an annular flange and includes a flexible central membrane with at least one slit there through that does not extend to the annular flange forming at least two flexible sealing flaps.

2. The capless retractable sealed writing instrument of claim 1, wherein said sealing chamber is separate from said wiper seal piece which is maintained in abutting relationship with said sealing chamber at a first end of said sealing chamber, and said sealing chamber is separate from said forward seal piece which is abutting said chamber adjacent an opposite end of said chamber, said forward seal piece having said annular flange which is held within the marker housing in a plane generally perpendicular to a longitudinal axis of said marker housing.

3. The capless retractable sealed writing instrument of claim 2, wherein the sealing chamber comprises a generally-circular, peripheral wall defining a hollow bore suitable for passage of a cylindrical reservoir portion there through; an annular forward terminus at one end of said peripheral wall adapted for compressing said as annular flange of a said forward seal piece; and an annular rearward terminus at an opposite end of said peripheral wall having a flat edge at one end adapted for compressing said wiper seal piece which is encircling the reservoir portion.

4. The capless retractable sealed writing instrument of claim 3, wherein said forward seal piece includes at least two of said slits formed through the flexible central membrane forming greater than two flexible sealing flaps which are adapted to permit extension and retraction of the marker nib therethrough.

5. The capless retractable sealed writing instrument of claim 4, wherein said seal piece extends from an annular flange.

6. The capless retractable sealed writing instrument of claim 5, wherein the forward seal piece has a collapsible bellows shape for greater extension of said nib through said sealing flaps.

7. The capless retractable sealed writing instrument of claim 1, wherein the marker carrier mechanism comprises a marker reservoir receiver, a release spring, and a plunger in linear alignment with said reservoir, said plunger being movable along a longitudinal axis of said writing instrument.

8. The capless retractable sealed writing instrument of claim 1, wherein the marker carrier mechanism comprises a marker reservoir receiver and a plunger in linear alignment with the pushrod.

9. The capless retractable sealed writing instrument of claim 1, wherein said chamber wall also comprises first and second wall portions, wherein said wall portions are attached at a step portion, said first wall portion having a larger outside diameter than said second wall portion.

10. The capless retractable sealed writing instrument of claim 1, wherein said housing further comprises a tip portion in engagement with a first end of the marker housing and axially aligned therewith, and an axial tip opening for the marker nib to be advanced by the marker carrier mechanism through the forward seal piece and further through the axial tip opening in the tip portion to reach a fully- extended position exposing the nib for writing.

11. The capless retractable sealed writing instrument of claim 10, wherein said wiper piece extends from an annular flange adjacent the marker housing.

12. The capless retractable sealed writing instrument of claim 1, wherein the peripheral wall of the seal chamber includes an intermediate shoulder defining a first outer diameter and a second outer diameter along said peripheral wall, and said peripheral wall also being tapered axially slightly inwardly.

13. The capless retractable sealed writing instrument of claim 12, wherein said chamber is separate from said forward seal piece and the wiper seal piece and has a rim portion at one end and a bead depending from said rim portion, said bead impressing upon one said seal piece to provide positive airtight contact therebetween.

14. The capless retractable sealed writing instrument of claim 13, wherein said bead having a profile selected from a group consisting of: semicircular, pointed, rectangular, or serrated, such that said bead, when compressed in contact with a resilient seal flange, will at least partially impinge upon said resilient flange to prevent radial slip and ensure sealing engagement with said flange.

15. The capless retractable sealed writing instrument of claim 1, wherein said forward seal piece also comprises at least one member projecting radially inwardly to prevent the forward seal piece from inverting upon retraction of the marker nib.

16. The capless retractable sealed writing instrument of claim 1, wherein said wiper seal piece includes an annular flange which is separate from the annular flange of the forward seal piece.

17. The capless retractable sealed writing instrument of claim 1, wherein said marker reservoir also comprises at least one internal vent tube.

18. The capless retractable sealed writing instrumental claim 1, wherein said forward seal piece includes at least two intersecting slits.

19. The capless retractable sealed writing instrument of claim 1, wherein said reservoir also includes an airtight plug in an end opposite from said nib.

20. The capless retractable sealed writing instrument of claim 1, wherein said housing having a contoured profile, with an indentation proximate the tip portion for facilitating a writer's grip between thumb and forefinger and having a partially non-circular radial shape to inhibit the marker from rolling on a tilted flat surface.

21. The capless retractable sealed writing instrument of claim 1, wherein the chamber portion includes structural support members.

22. The capless retractable sealed writing instrument of claim 1, wherein said peripheral wall of said chamber changes in diameter along a longitudinal length thereof.

23. The capless retractable sealed writing instrument of claim 1, wherein the elongated marker housing has a hollow interior with an axial opening at eithr end.

24. In a capless retractable marking instrument, a forward chamber portion for sealingly enclosing a marker nib when the marking instrument is retracted, the forward chamber portion comprising: a generally-circular peripheral wall defining a hollow bore suitable for passage of a cylindrical reservoir portion therethrough; an annular forward terminus at one end of said peripheral wall adapted for compressing an annular rim of a seal portion; and an annular rearward terminus at an opposite end of said peripheral wall having a flat edge at one end adapted for compressing an elastomeric wiper seal encircling the reservoir portion, wherein said seal portion is adhesively affixed on said forward terminus, said seal portion comprising: an annular flange portion in adhesive contact with said forward terminus; a circular head portion; and a hollow cylindrical sidewall connecting said forward terminus and said head portion; wherein said head portion including a flexibly-resilient, reclosable aperture adapted to permit extension and retraction of the marker nib therethrough.

* * * * *